United States Patent [19]

Arai et al.

[11] 4,438,739

[45] Mar. 27, 1984

[54] HYDRAULIC LASH ADJUSTER

[75] Inventors: Fuminao Arai, Kariya; Hisashi Kodama, Nagoya; Yoshio Okabe, Kariya, all of Japan

[73] Assignee: Aisin Seiki Kabushiki Kaisha, Kariya, Japan

[21] Appl. No.: 240,337

[22] Filed: Mar. 4, 1981

[30] Foreign Application Priority Data

Mar. 6, 1980 [JP] Japan ..... 55-28481

[51] Int. Cl.[3] ..... F01L 1/24

[52] U.S. Cl. ..... 123/90.55; 123/90.46; 123/90.43

[58] Field of Search ..... 123/90.43, 90.46, 90.55, 123/90.56, 90.57, 90.58, 90.59, 90.35; 137/202, 433

[56] References Cited

U.S. PATENT DOCUMENTS 2,787,376 4/1957 Coulson ..... 137/433
3,805,753 4/1974 Bergmann et al. ..... 123/90.55
3,877,445 4/1975 Barnes ..... 123/90.46
4,296,778 10/1981 Anderson ..... 137/433
4,338,894 7/1982 Kodama ..... 123/90.46

FOREIGN PATENT DOCUMENTS 54-141915 11/1979 Japan ..... 123/90.57

*Primary Examiner*—Craig R. Feinberg
*Assistant Examiner*—W. R. Wolfe
*Attorney, Agent, or Firm*—Sughrue, Mion, Zinn, Macpeak & Seas

[57] ABSTRACT

An hydraulic lash adjuster of the type used in the valve trains of internal combustion engines in order to take up the lash for operating clearance includes a cylindrical body member, a plunger member having a reservoir chamber therein being slidably mounted in the body member to define a pressure chamber therebetween, passage means between the reservoir chamber and the pressure chamber controlled by a one-way valve and a floating member disposed on the surface of the hydraulic fluid contained in said reservoir chamber to prevent air from being absorbed into the hydraulic fluid during the operation of the engine.

5 Claims, 4 Drawing Figures

HYDRAULIC LASH ADJUSTER

BACKGROUND OF THE INVENTION

1. Field of the Invention

The present invention is directed to hydraulic lash adjusters used in the valve trains of internal combustion engines and more particularly to a self-contained hydraulic lash adjuster of the type having a pressure chamber, a reservoir chamber and floating means within said reservoir chamber to prevent the absorption of air into the fluid during operation of the engine.

2. Prior Art

In the valve trains of internal combustion engines predetermined valve clearances are generally provided in order to compensate for thermal expansion of various parts in the valve trains. However, since excess lash may be generated due to the valve clearances in the valve trains during engine operation hydraulic lash adjusters have been used for automatically taking up the valve clearances in the valve trains thereby preventing any possible lash in stabilizing the opening and closing operation of the engine intake and exhaust valves. The elimination of excess lash prevents undesirable power losses and undesirable noises which might otherwise occur during the operation of the engine.

Conventional self-contained lash adjuster devices generally include a pressure chamber and a reservoir chamber containing an hydraulic fluid with the two chambers being disposed in communication with each other through an opening controlled by means of a one-way check valve which will allow the flow of fluid from the reservoir chamber to the pressure chamber. The flow of fluid from the pressure chamber to the reservoir chamber generally takes place through a leakage clearance between a plunger containing the reservoir chamber and the housing and a passage through the wall of the plunger. However, such conventional lash adjuster devices suffer from the disadvantage that air can be absorbed into the hydraulic fluid which is generally a silicon oil having a high viscosity which will then impair the effective operation of the lash adjuster. When the capacity of the pressure chamber suddenly increases due to upward movement of the plunger any air within the reservoir chamber will become absorbed into or entrained by the high viscosity oil as it flows into the pressure chamber. Such an absorption of air creates undesirable tapping sounds in the operation of the lash adjuster and leads to inferior operating qualities.

An example of a self-contained hydraulic lash adjuster is disclosed in the U.S. Pat. No. 4,191,142 to Kodama. The lash adjuster disclosed in the Kodama patent includes a cylinder member and a plunger member slidably fitted therein to define a fluid pressure chamber between the end walls thereof. The plunger member is provided with a reservoir chamber and an elastic bag member is disposed within the reservoir chamber with the inner surface of the elastic bag member being normally in communication with atmospheric pressure while the outer surface thereof is disposed in contact with the fluid reservoir chamber. While the elastic bag member will compensate for changes in the fluid volume in the reservoir chamber during operation there is still the possibility of air within the reservoir chamber becoming absorbed into or entrained by the hydraulic fluid during operation.

SUMMARY OF THE INVENTION

It is a principal object of the present invention to provide an improved hydraulic lash adjuster which prevents air from being absorbed into or entrained by the hydraulic fluid or oil and which thereby overcomes the disadvantages associated with conventional hydraulic lash adjusters.

It is another object of the present invention to provided an hydraulic lash adjuster which has a floating member disposed in the reservoir chamber in order to prevent air from being absorbed into the oil contained in the chamber. The floating member may have a disc-like configuration which is completely hollow or of a substantially solid resin material having a plurality of hollow cells therein.

It is a further object of the present invention to provide an hydraulic lash adjuster which is simple in construction and inexpensive to manufacture.

The foregoing and other objects, features and advantages of the invention will be apparent from the following more particular description of preferred embodiments of the invention as illustrated in the accompanying drawings.

DETAILED DESCRIPTION OF THE INVENTION

Figure 1:
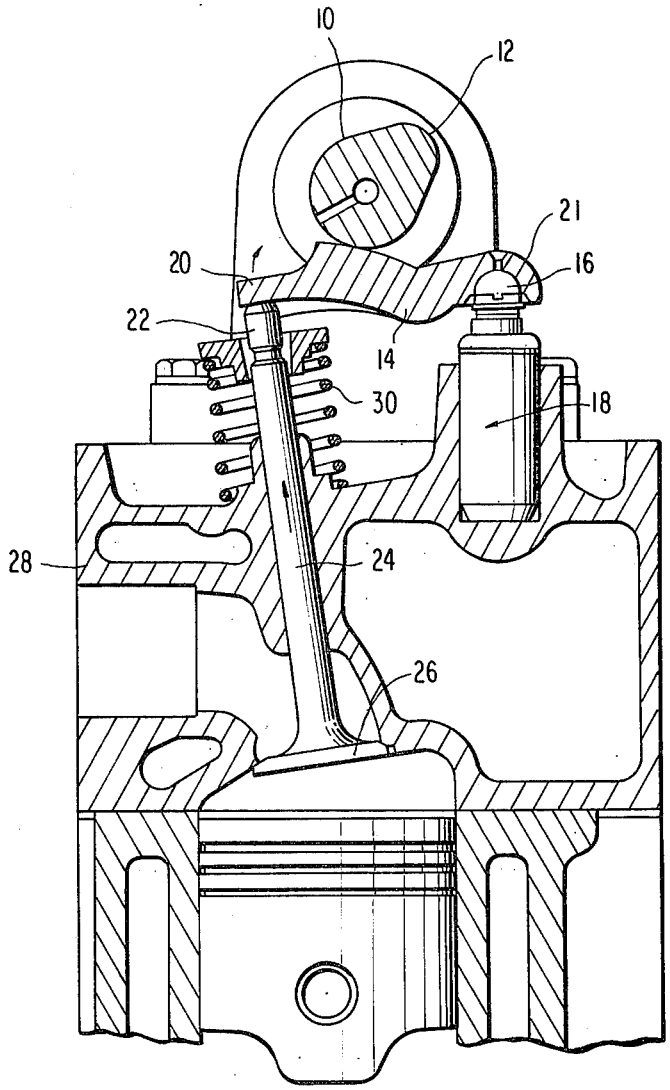
FIG. 1 is a longitudinal sectional view through a portion of an internal combustion engine having a valve operating mechanism incorporating a self-contained hydraulic lash adjuster constructed in accordance with the present invention.

A portion of a conventional internal combustion engine is shown in FIG. 1 of the type having an overhead cam shaft 10 with a cam portion 12 integrally formed therewith. The cam shaft 10 is disposed in contact with the rocker arm 14 which has one end 21 disposed in engagement with the fulcrum 16 of the lash adjuster 18. The opposite end 20 of the rocker arm 14 is disposed in engagement with one end 22 of the valve stem 24 which has a valve 26 formed on the opposite end thereof. The valve 26 is biased into engagement with the cylinder head 28 by valve springs 30 which operatively engages the valve stem 24.

Figure 2:
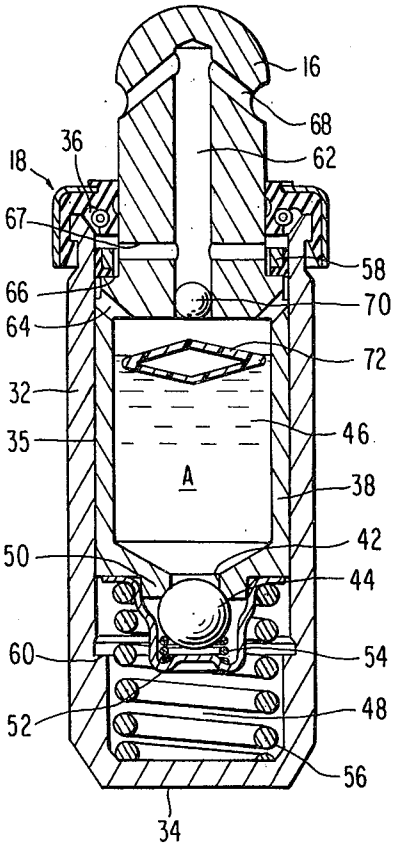
FIG. 2 is an enlarged longitudinal sectional view of the lash adjuster shown in FIG. 1 showing the internal parts thereof in detail.

The lash adjuster 18 is shown in detail in FIG. 2 and includes a hollow cylindrical body 32 having a bottom wall 34 at one end while the opposite end is provided with an opening 36. A hollow plunger 38 having a fulcrum 40 at the upper end thereof is slidably mounted in the hollow body 32 for reciprocating movement therein. The bottom wall 50 of the plunger 38 is provided with a passage 42 which is normally maintained in the closed position by means of a one-way check valve 44. A reservoir chamber 46 is located within the plunger 38 and a pressure chamber 48 is defined between the bottom wall 50 of the plunger 38 and the bottom wall 34 of the body 32 so that the pressure chamber 48 and the reservoir chamber 46 are disposed in communication with each other through passage 42 under the control of the valve 44. A cup-shaped retainer 52 is secured to the bottom wall 50 of the plunger 38 and the ball valve 44 is located therein and biased toward the passage 42 by means of a spring 52 disposed between the retainer 52 and the ball valve 44. A plunger return spring 56 is disposed between the bottom wall 34 of the housing and the spring retainer 52 for biasing the plunger 38 upwardly relative to the housing 32. A stop ring 58 is located within the body at the upper end thereof for limiting the upward movement of the plunger 38 relative to the body 32. Similarly, a flange 60 in the lower end of the body 32 acts as a stop to limit the downward movement of the plunger 38 within the body 32.

The fulcrum 16 is provided with a longitudinal passage 62 at the center thereof and the plunger 38 is provided with inclined passages 64 at the upper end thereof. A plurality of radially extending passages 67 extend outwardly from the central passage 62. Communication between the radially extending passages 67 and the passages 64 is prevented when the shoulder 66 of the plunger 38 is disposed in engagement with the limiting ring 58. When the plunger 38 moves downwardly out of engagement with the limiting ring 58 atmospheric air may be communicated to the reservoir chamber 46 through passages 68 adjacent the fulcrum 16, the central passage 62, radial passages 67 and passages 64. A ball 70 is pressed into the passage 62 adjacent the reservoir chamber 46 so as to prevent the working fluid A such as a silicon oil contained with the reservoir chamber 46 from entering the central passage 62 even though the engine should be inverted.

A floating member 72 is disposed on the upper surface of the fluid A in the reservoir chamber. The floating member 72 is constructed of resin material having a hollow center of diamondshaped cross-sectional configuration. However, the shape and material of the floating member 72 is somewhat immaterial as long as the member is capable of floating on the fluid A.

During operation of the internal combustion engine the cam shaft 10 will rotate in accordance with the rotation of the engine crank shaft (not shown). One end 20 of the rocker arm 14 will be forced downwardly by the cam portion 12 of the cam shaft 10 thereby forcing the valve stem 24 downwardly against the valve spring 30 so as to open the engine valve 26. The resistance of the valve stem 24 to the downward movement of the end 20 of the rocker arm causes the opposite end 21 of the rocker arm to impart a downward force to the fulcrum 16 of the lash adjuster 18. The downward movement of the fulcrum 16 and plunger 38 increases the pressure on the fluid within the pressure chamber 48. The increased pressure in the pressure chamber 48 assists the spring 54 in maintaining the valve 44 closed thereby preventing fluid from entering into the reservoir chamber 46 through passage 42. The hydraulic fluid within the pressure chamber 48 is consequently forced upwardly through the clearance 35 between the plunger 38 and the body 32. The fluid will then pass from the clearance through the passages 64 into the reservoir chamber 46.

Upon further rotation of the cam shaft 10 the rocker arm 14 will allow the fulcrum 16 and the plunger 38 to be moved upwardly by the force of spring 56. Thus, the oil pressure in chamber 48 will be lowered thereby allowing the check valve 44 to be opened so that hydraulic fluid can pass from the reservoir chamber 46 to the pressure chamber 48 through the passage 42 against the force of the spring 54.

The floating member 72 will move upwardly and downwardly in accordance with the level of the hydraulic fluid within the reservoir chamber 46 so that the floating member 72 will prevent any air above the hydraulic fluid from being absorbed into the fluid upon subsequent sudden downward movement of the plunger 38 during engine operating. Since air is prevented from being absorbed or entrained by the hydraulic fluid undesirable tapping sounds will be prevented and the quality of the hydraulic fluid will be maintained at an acceptable level.

Figure 3:
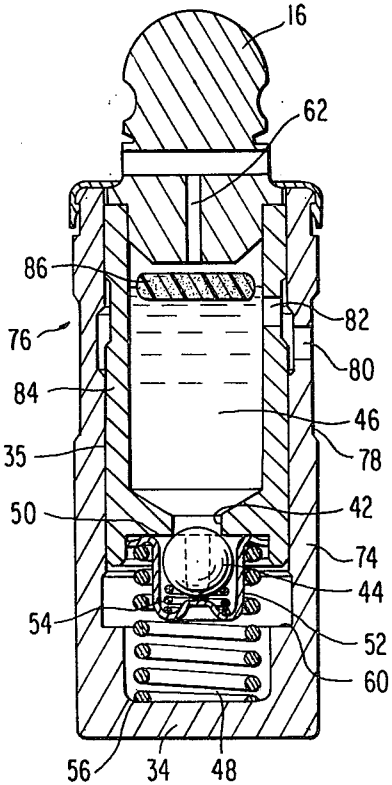
FIG. 3 is a longitudinal sectional view through the lash adjuster of another embodiment according to the present invention showing the internal parts thereof in detail.

Another embodiment of the present invention is shown in FIG. 3 wherein the same numerals will be used to indicate elements substantially identical to those indicated in FIGS. 1 and 2. In this embodiment the engine oil is used as the operating fluid and is transmitted to the lash adjuster by means of an annular groove 78 formed in the outer surface of the body 74. At least one radial passage 80 is provided through the wall of the body 74 in communication with the recess 78 which communicates with at least one radial passage 82 extending through the wall of the plunger 84 which is slidable within the body 74. The passages within the engine for supplying oil to the recess 78 and passages 80 and 82 are old and well known in the art and a detailed illustration thereof is not deemed necessary in the present application. A floating member 86 is provided on the upper surface of the hydraulic fluid within the reservoir chamber 46. The floating member 86 is comprised of a porous resin material having a low specific gravity. The floating member 86 serves to prevent the air above the hydraulic fluid from being absorbed into the hydraulic fluid during operating of the lash adjuster.

Figure 4:
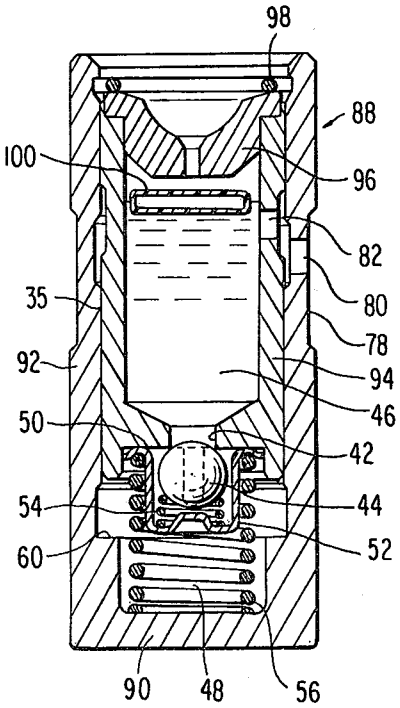
FIG. 4 is a longitudinal sectional view through the lash adjuster according to still another embodiment of the present invention showing the internal parts thereof in detail.

A further embodiment of the invention is shown in FIG. 4 wherein the same numerals are used to identify elements similar to elements in the previous embodiments of FIGS. 1, 2 and 3. According to this embodiment the lash adjuster 88 is of the type suitable for use with a valve lifter arrangement where the cam shaft (not shown) engages the bottom wall 90 of the body 92 of the lash adjuster 88. A cup member 96 is secured within the upper end of the body 92 in engagement with the plunger 94. The cup 96 is adapted to engage the lower end of the valve lifter rod to operate the valve of the engine through a suitable rocker arm. A retaining ring 98 is provided in the upper inside wall of the body 94 to limit the upward movement of the plunger 94 and the cup 96. The floating member 100 of this embodiment is constructed as a flat, hollow disc which will prevent the air above the hydraulic fluid from being absorbed by the hydraulic fluid during operation.

As previously described, the lash adjuster according to the present invention includes a floating member in the reservoir chamber which will prevent air from being absorbed from the reservoir chamber into the hydraulic fluid and from being drawn into the pressure chamber due to the high viscosity of the operating oil when the capacity of the pressure chamber is suddenly increased and the aperture is opened by the check valve. Consequently the tapping sound occuring at the beginning of engine operation is reduced and the operating oil is maintained in good condition as a result of the presence of the floating member.

While the invention has been particularly shown and described with reference to preferred embodiments thereof, it will be understood by those in the art that the foregoing and other changes in form and details may be made therein without departing from the spirit and scope of the invention.

What is claimed is:

1. An hydraulic lash adjuster comprising a hollow cylindrical body member having a bottom wall at one end thereof, a hollow plunger member having a bottom wall at one end thereof and an upper wall at the upper end thereof slidably disposed within said body member, said plunger and said body member defining a pressure chamber between the bottom walls thereof, said plunger member having a reservoir chamber therein and an aperture in said bottom wall thereof, check valve means operatively associated with said aperture to permit fluid contained in said reservoir chamber to pass through said aperture to said pressure chamber while preventing fluid flow in the opposite direction, clearance means between said body member and said plunger member and passage means through said plunger means communicating said clearance means with said reservoir chamber, spring means located in said pressure chamber for biasing said plunger member away from the bottom wall of said body member and a structurally independent, free floating member disposed on and substantially covering the upper surface of said hydraulic fluid in spaced relation to said upper wall of said reservoir to prevent air above the fluid from being absorbed by the fluid in operation.

2. A hydraulic lash adjuster according to claim 1 wherein said floating member is comprised of a hollow disc of resin material.

3. A hydraulic lash adjuster according to claim 1 wherein said floating member is comprised of a porous disc of resin material.

4. A hydraulic lash adjuster according to claim 2 wherein said floating member has a diamond-shaped cross-sectional configuration in elevation.

5. A hydraulic lash adjuster as set forth in claim 2 wherein said floating member has a rectangular cross-sectional configuration in elevation.

* * * * *